United States Patent [19]

Johnson

[11] 4,093,110

[45] June 6, 1978

[54] NOISE AND FOULING REDUCER FOR POWDER-ACTUATED TOOL

[75] Inventor: Peter Walton Johnson, Toronto, Canada

[73] Assignee: Olin Corporation, New Haven, Conn.

[21] Appl. No.: 776,570

[22] Filed: Mar. 11, 1977

[51] Int. Cl.[2] ..... B25C 1/18

[52] U.S. Cl. ..... 227/9; 181/230; 181/243; 181/264

[58] Field of Search ..... 227/8, 9, 10, 11; 181/36 R, 36 A, 36 C, 36 D, 36 E, 3 T, 41, 42, 46, 47 R, 49, 56, 57, 63, 69

[56] References Cited

U.S. PATENT DOCUMENTS

| | | | |
|---|---|---|---|
| 2,395,005 | 2/1946 | Kuhn | 181/49 |
| 2,514,998 | 7/1950 | Fundom | 181/69 |
| 3,172,120 | 3/1965 | DeCaro et al. | 227/10 |
| 3,255,844 | 6/1966 | Wallace | 181/46 |
| 3,563,439 | 2/1971 | Pomeroy | 227/8 |
| 3,779,342 | 12/1973 | Broberg, Jr. | 181/69 |

*Primary Examiner*—Granville Y. Custer, Jr.
*Attorney, Agent, or Firm*—Paul J. Lerner; William W. Jones

[57] ABSTRACT

A chamber is formed on a powder-actuated tool into which the combustion gases generated by firing the tool are directed. The chamber contains a plurality of baffle plates which absorb noise and provide increased surface area for precipitation of fouling deposits carried by the combustion gases. The plates are easily removable for cleaning. The chamber is formed in a box-like housing which can be secured to a conventional indirect firing tool with minimal adaptation necessary.

12 Claims, 5 Drawing Figures

NOISE AND FOULING REDUCER FOR POWDER-ACTUATED TOOL

This invention relates to powder-actuated tools for use in explosively setting fasteners in concrete, masonary, and the like, and particularly to an assembly for reducing noise and fouling of such tools.

The use of powder-actuated tools for setting fasteners is wide spread in the construction industry. A worker using such a tool, depending on the job he is doing, will fire the tool between two hundred and six hundred times a day, with some workers firing even more times. In order to protect the worker's ears, he is advised to wear ear plugs, however, this advice is not always followed.

This invention relates to an assembly which is used with a powder-actuated tool to reduce the noise of the tool when fired and to reduce fouling of the firing chamber and internal moving parts of the tool, which fouling is the result of condensation of combustion gases inside of the tool. The assembly includes a housing which is secured to the receiver of the tool and which contains a chamber into which combustion gases from the tool are diverted. The chamber is provided with a one-way check valve at its inlet so that the combustion gases are trapped inside of the housing while they depressurize and condense out. A plurality of baffle plates are disposed in the chamber to provide an increased surface area therein for condensation products to precipitate onto, and to diffuse and muffle the noise produced by the expanding gases. The plates may be easily removed from the chamber for cleaning when necessary. A deflector plate may also be included when the assembly is to be used with an indirect tool having a ram for driving the fasteners.

It is, therefore, an object of this invention to provide a noise reducing assembly for use with a powder-actuated tool.

It is a further object to provide an assembly of the character described having means forming precipitation surfaces where combustion gas products are deposited away from the interior of the tool.

These and other objects and advantages of the invention will become more readily apparent from the following detailed description of a preferred embodiment of the invention taken in conjunction with the accompanying drawings, in which.

Figure 1:
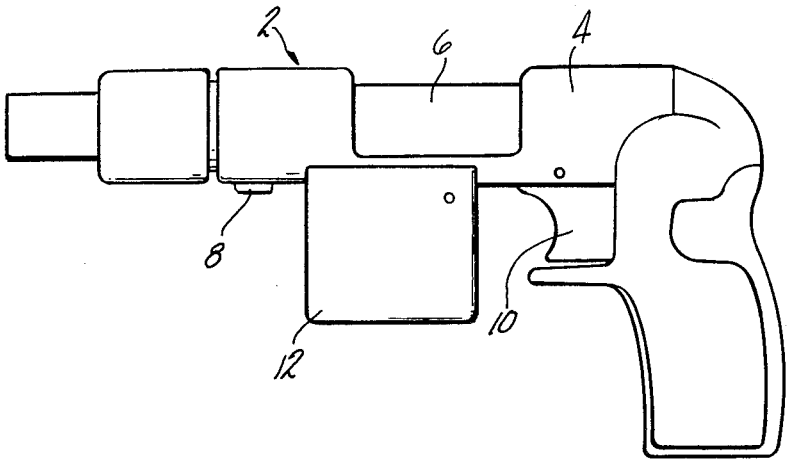
FIG. 1 is a side elevational view of a powder-actuated indirect fastener setting tool having the noise and fouling reducing assembly mounted thereon.

Referring now to FIG. 1, a powder-actuated fastener driving tool 2 of the indirect driving type is shown. The tool includes a receiver 4, a barrel 6 reciprocally movable with respect to the receiver 4, a ram-return pawl 8 fixed to the receiver 4 for returning a fired piston or ram to its battery position when the barrel 6 is pulled forward, and a trigger 10. The firing mechanism of the tool may be conventional, and the tool may be of the type which uses cased or caseless propellant charges. Affixed to the receiver 4 is the noise and fouling reducer housing 12.

Figure 2:
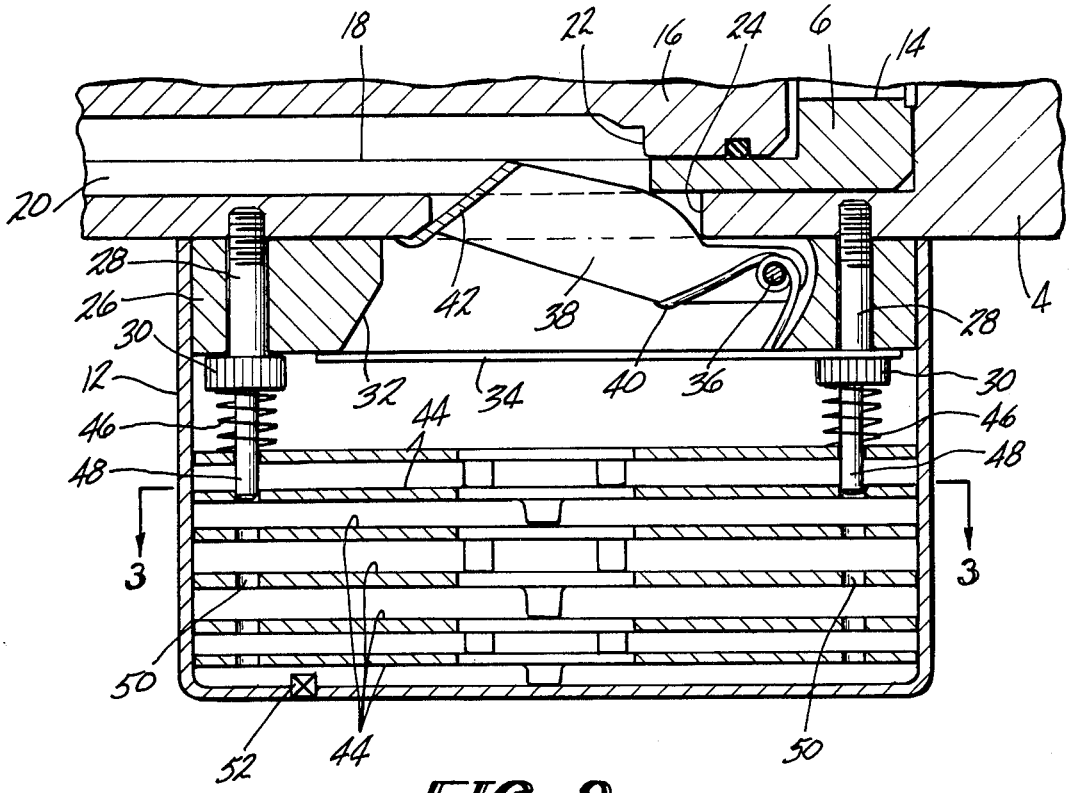
FIG. 2 is an enlarged fragmented vertical sectional view of the reducer assembly and part of the tool, the piston of the tool being shown in its battery position.
Figure 3:
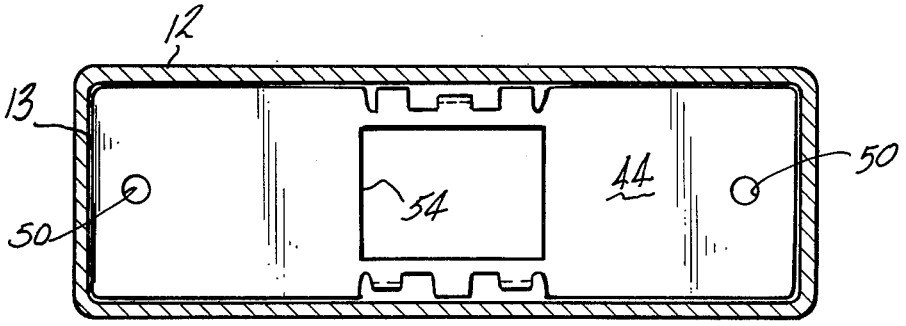
FIG. 3 is a horizontal sectional view taken along line 3—3 of FIG. 2.

Referring now to FIGS. 2 and 3, construction of the noise and fouling reducing assembly is shown. As will be noted, the tool firing chamber 14 is disposed in the breech end of the barrel 6. The piston or ram 16 is shown in its rearward battery position in FIG. 2, within the bore 18 of the barrel 6. A slot 20 is cut through the lower portion of the barrel 6 to enable the pawl 8 (see FIG. 1) to engage the head 22 of the piston 16 to return the latter from its fired position to its battery position as the barrel 6 is pulled forward with respect to the receiver 4. A slot 24 is also cut through the lower surface of the receiver 4 adjacent to the barrel slot 20 so that the two slots 20 and 24 communicate with each other when the barrel 6 is in its breech-closed position, shown in FIG. 2. The housing 12 is attached to an end block 26 and the block 26 is secured to the tool receiver 4 by means of bolts 28 and nuts 30. The block 26 includes a gas passage 32, the lower end of which is closed by a deflectable reed valve 34 in the form of a thin sheet of spring steel held in place by the rearwardmost nut 30. A pin 36 extends laterally of the housing 12 within the gas passage 32 to provide a means for pivotally mounting a gas deflecting member 38 therein. A torsion spring 40 is mounted on the pin 36 and engages the block 26 and member 38 to bias the latter in a clockwise direction about the pin 36 to a gas-deflecting operative position shown in FIG. 2. The member 38 includes a transverse web 42 against which combustion gases are directed from the barrel bore 18 when the tool is fired and the piston 16 thrust forward. The web 42 diverts the combustion gas down into the gas passage 32.

Disposed in the housing 12 below the reed valve 34 is a stack of baffle plates 44. The baffle plates 44 are preferably not secured in any way to the housing 12, but are merely loosely stacked therein. They are held in place by a pair of springs 46 which are mounted on spring guide portions 48 of the bolts 28. The springs 46 are under compression and bear on one end against the nuts 30 and on the other end against the uppermost baffle 44 in the stack. The baffles are formed with openings 50 which receive the ends of the spring guides 48. A poppet valve 52 may be mounted on the lower wall of the housing 12 to be operative to exhaust only low pressure gases therefrom.

Figure 4:
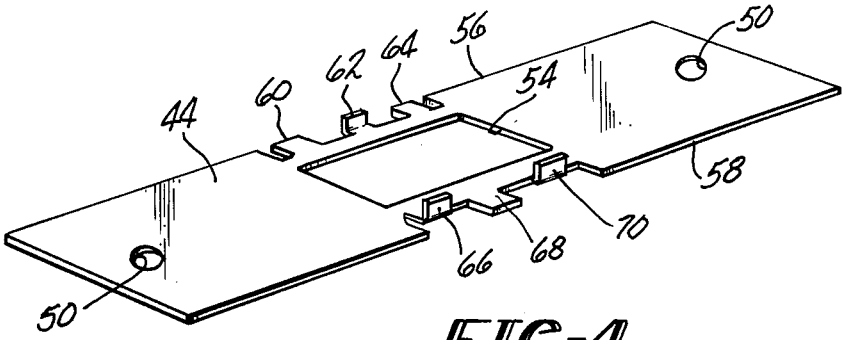
FIG. 4 is a perspective view of the underneath side of one of the removable baffle plates used in the invention.

Referring now to FIGS. 3 and 4, the nature of the baffles 44 will be explained. As can be seen from FIG. 3, each baffle 44 has the same outline as the chamber 13 formed by the housing 12. Thus the baffles 44 fit snugly within the chamber 13, but can be easily removed therefrom for cleaning. All of the baffles 44 are preferably identical to each other and include an opening 54 which allows gas ducted into the chamber 13 to pass into and infiltrate the baffle stack.

For clarity, the baffle 44 is shown in FIG. 4 inverted from the position in which it is inserted and stacked in the chamber 13. The lateral sides 56 and 58 of the baffle 44 are each formed with three integral spaced tabs 60, 62 and 64 on the side 56, and 66, 68 and 70 on the side 58. On one side the middle tab is bent at right angles to the plane of the baffle, and on the other side the end tabs are both bent at right angles to the plane of the baffle. The baffles are stacked in alternating fashion, as will be apparent from FIG. 2. Thus the straight tabs provide surfaces for the bent tabs on the next upwardly adjacent baffle to rest upon. The bent tabs serve as spacers for the baffles to open up the interior of the stack for circulation of combustion gases. Thus the upper and lower surfaces of each baffle are exposed to the combustion gases and provide surfaces upon which the condensation products in the combustion gases may precipitate as the gases cool and lose pressure in the chamber 13. The stack of baffles thus greatly increases the available surface area inside of the chamber upon which combustion gas products may condense, greatly increasing the capacity and life of the assembly. The baffles also tend to muffle and reduce the sound of the expanding combustion gases entering the chamber 13, thereby quieting the tool.

Figure 5:
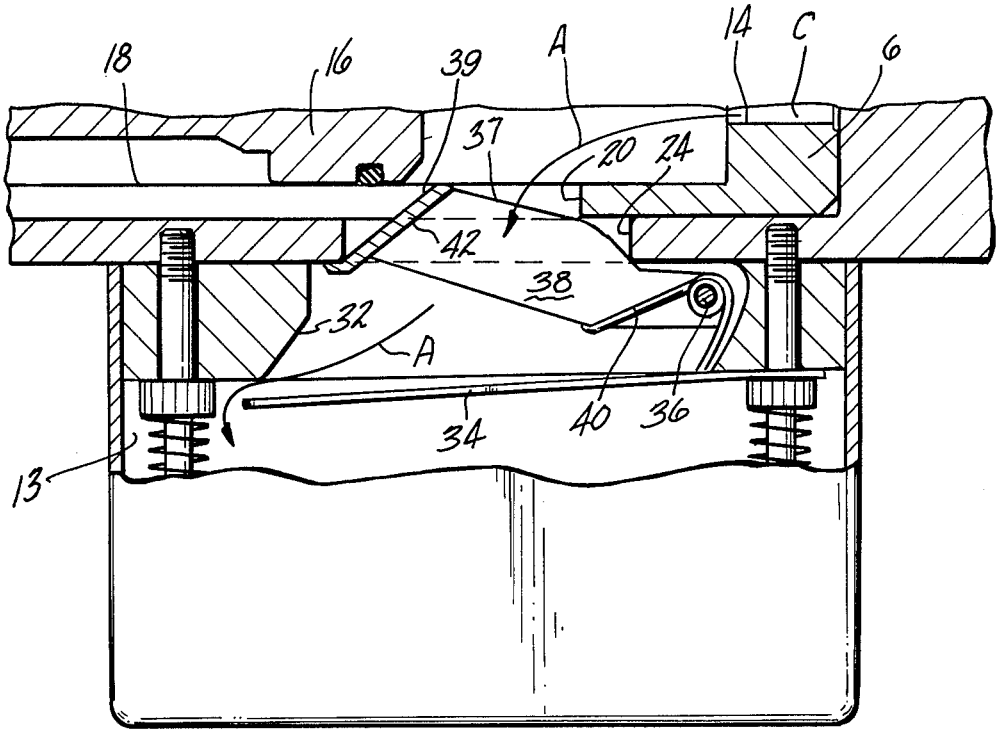
FIG. 5 is a sectional view similar to FIG. 2 but showing operation of the assembly to deflect and receive combustion gases from the interior of the tool.

Referring now to FIG. 5, operation of the assembly is shown. A cartridge C in the tool firing chamber 14 has been fired to generate combustion gases which expand forwardly and drive the piston 16 forward through the barrel bore 18. The combustion gases pass through the barrel pawl slot 20 and the receiver slot 24 impinging the deflector web 42 so as to be deflected down through the gas passage 32 along the lines denoted generally by the arrows A. This gas pressure causes deflection of the reed valve 34 so that the gases flow into the reaction chamber 13 where they are muffled and condensed. Low pressure residual gases may be passed from the chamber 13 through the poppet valve 52 (see FIG. 2) which opens after a predetermined pressure decay.

When the barrel 6 is reciprocated to return the piston 16 to its battery position, upon the forward movement stroke, the rear end wall of the barrel slot 20 rides over a camming surface 37 on the deflector 38 causing the latter to pivot downwardly about the pin 36, against the bias of the spring 40, and into the gas passage 32 thus clearing forward movement of the barrel 6. Upon rearward return movement of the barrel 6, the rear end wall of the barrel 6 rides over a second camming surface 39 on the deflector 38 again causing the deflector 38 to pivot down into the gas passage 32 clearing the barrel 6 for return to its battery position. Once the barrel 6 is in its battery position, the deflector 38 is returned to its operative position, shown in FIG. 5, by the spring 40.

It will be appreciated that the assembly of this invention will provide improved sound reduction and less tool fouling than previously available. The housing 12 will be secured to the block 26 in such a way as to be substantially gas-tight, but removable so that the housing can be removed from the tool and the baffles withdrawn therefrom and cleaned. This may be accomplished by an interference fit between the housing 12 and the block 26 as seen in FIGS. 2 and 5. Alternatively, mechanical fasteners, such as screws, may be employed to provide the desired securement. The construction is simple and the assembly may be used on pre-existing tools with relatively little modifications necessary.

Since many changes and variations of the disclosed embodiment of the invention may be made without departing from the inventive concept, it is not intended to limit the invention otherwise than as required by the appended claims.

What is claimed is:

1. A powder-actuated tool for driving fasteners into supporting structures, said tool comprising: a firing chamber for receiving a powder charge; a barrel having a bore into which combustion gases from the powder charge are directed to power the tool; gas passage means extending from said barrel bore into a chamber on the tool for receiving the combustion gases; and a plurality of baffle plates mounted in said chamber to provide increased surface area therein for deposition of fouling deposits from the combustion gases and for muffling the sound of the expanding combustion gases; said baffle plates being arranged in a stack within said chamber with passages being formed in the individual baffle plates to allow the combustion gases to infiltrate said stack; each of said baffle plates being identical to the others in construction, and said baffle plates being loosely stacked within said chamber so as to be removable therefrom for cleaning; and spring means for biasing said baffle plates into engagement with each other to retain the composition of said stack.

2. A powder-actuated tool for driving fasteners into supporting structures, said tool comprising: a firing chamber for receiving a powder charge; a barrel having a bore into which combustion gases from the powder charge are directed to power the tool; gas passage means extending from said barrel bore into a chamber on the tool for receiving the combustion gases; a plurality of baffle plates mounted in said chamber to provide increased surface area therein for deposition of fouling deposits from the combustion gases and for muffling the sound of the expanding combustion gases; and a one-way check valve in said gas passage means for allowing gas under pressure to flow from said barrel bore into said chamber, but not in the reverse direction.

3. A powder-actuated tool for driving fasteners into supporting structures, said tool comprising: a firing chamber for receiving a powder charge; a barrel having a bore into which combustion gases from the powder charge are directed to power the tool; gas passage means extending from said barrel bore into a chamber on the tool for receiving the combustion gases; a plurality of baffle plates mounted in said chamber to provide increased surface area therein for deposition of fouling deposits from the combustion gases and for muffling the sound of the expanding combustion gases; and a gas deflector mounted on said tool for diverting gas from said barrel bore into said gas passage means.

4. The tool of claim 3, wherein said tool is of the indirect firing type and includes a piston slidably mounted in said barrel bore; a piston-return pawl mounted on said tool for returning said piston to a retired position upon reciprocation of said barrel; a slot in said barrel permitting said pawl to engage said piston, said slot forming a part of said gas passage means; said gas deflector extending into said slot when said barrel is in a battery position; means movably connecting said gas deflector to the tool; means biasing said gas deflector into said slot; and cam means formed on said gas deflector to engage said barrel when the latter is reciprocated to move said gas deflector out of said barrel slot so as not to interfere with the piston return operation of the tool.

5. A powder-actuated tool for driving fasteners into supporting structures, said tool comprising: a firing chamber for receiving a powder charge; a barrel having a bore into which combustion gases from the powder charge are directed to power the tool; gas passage means extending from said barrel bore into a chamber on the tool for receiving the combustion gases; and a one-way check valve mounted in said gas passage means to permit flow of combustion gases from said barrel bore into said chamber, but prevent flow of combustion gases in the reverse direction.

6. The tool of claim 5, further comprising deflector means mounted adjacent to said passage means to deflect combustion gases from said barrel bore into said gas passage means.

7. A powder-actuated tool for driving fasteners into supporting structures, said tool comprising: a firing chamber for receiving a powder charge; a barrel having a bore into which combustion gases from the powder charge are directed to power the tool; a receiver to which said barrel is movably connected; a piston movably mounted in said barrel bore between a battery and a fired position; a piston return pawl secured to said receiver and extending through a slot in said barrel to engage the piston and return it to its battery position when the barrel is appropriately moved; means mounted on said receiver to provide a chamber for the reception of combustion gases from said barrel bore; means including said barrel slot forming a gas passage between said barrel bore and said chamber; gas deflector means movably mounted in said gas passage and extending into said barrel slot to deflect combustion gases from said barrel bore into said chamber, said deflector means including means operable upon by said barrel to move said deflector means out of said barrel slot when said barrel is moved to return said piston to the battery position; and means engaging said deflector means to reposition the latter in said barrel slot when the tool is ready to fire.

8. The tool of claim 7, further comprising one-way check valve means in said gas passage for permitting flow of combustion gases from said barrel bore to said chamber while preventing flow of combustion gases in the reverse direction.

9. A powder-actuated tool for driving fasteners into supporting structures, said tool comprising: a firing chamber for receiving a powder charge; a barrel having a bore into which combustion gases from the powder charge are directed to power the tool; means connected to said tool forming a chamber for receiving combustion gases from said barrel bore; a gas passage extending between said barrel bore and said chamber; and a plurality of baffle plates removably positioned in said chamber to increase the surface area therein and to muffle noise caused by expanding combustion gases; said baffle plates being arranged in a stack with individual plates of stack being spaced apart from each other, the plates having openings formed therein for passage of combustion gases so that the combustion gases in the chamber will infiltrate the stack of plates; and spring means for biasing the plates into the stack arrangement to ensure maintenance of the latter.

10. The tool of claim 9, wherein said baffle plates are arranged in a stack with individual plates of the stack being spaced apart from each other, the plates having openings formed therein for passage of combustion gases so that the combustion gases in the chamber will infiltrate the stack of plates.

11. The tool of claim 10, wherein each of the plates is formed with integral spacer means for engaging the next adjacent plate to maintain separation of the plates in the stack.

12. The tool of claim 11, wherein each of the plates is identical in configuration.

* * * * *

Disclaimer 4,093,110.—*Peter Walton Johnson*, Toronto, Canada. NOISE AND FOULING REDUCER FOR POWER-ACTUATED TOOL. Patent dated June 6, 1978. Disclaimer filed July 14, 1980, by the assignee, *Olin Corporation.*

Hereby enters this disclaimer to claim 10 of said patent.

[*Official Gazette September 9, 1980.*]